US007896522B2

(12) United States Patent
Heller et al.

(10) Patent No.: US 7,896,522 B2
(45) Date of Patent: Mar. 1, 2011

(54) FRONTAL ILLUMINATION OF A SURFACE USING LED LIGHTING

(75) Inventors: Todd R. Heller, Marietta, GA (US); Dewey T. Pitts, Marietta, GA (US)

(73) Assignee: Formetco, Inc., Duluth, GA (US)

( * ) Notice: Subject to any disclaimer, the term of this patent is extended or adjusted under 35 U.S.C. 154(b) by 92 days.

(21) Appl. No.: 12/389,871

(22) Filed: Feb. 20, 2009

(65) Prior Publication Data

US 2009/0290338 A1 Nov. 26, 2009

Related U.S. Application Data

(60) Provisional application No. 61/029,952, filed on Feb. 20, 2008.

(51) Int. Cl.
*G09F 13/02* (2006.01)

(52) U.S. Cl. ..... 362/249.02; 362/235; 362/812; 362/249.01; 362/231; 362/244; 40/541

(58) Field of Classification Search ..... 362/800, 362/231, 235, 244, 812, 249.01, 249.02; 40/541–562

See application file for complete search history.

(56) References Cited

U.S. PATENT DOCUMENTS

| | | | | |
|---|---|---|---|---|
| 4,843,527 | A * | 6/1989 | Britt | 362/231 |
| 4,849,864 | A * | 7/1989 | Forrest | 362/225 |
| 6,510,633 | B1 | 1/2003 | Bledsoe | |
| 7,360,923 | B2 * | 4/2008 | Weber-Rabsilber et al. | 362/241 |
| 2005/0018428 | A1 | 1/2005 | Harvey | |
| 2007/0017131 | A1 | 1/2007 | Visotcky | |

FOREIGN PATENT DOCUMENTS

| | | | |
|---|---|---|---|
| EP | 0829844 | A2 | 9/1997 |
| EP | 0829844 | B1 | 9/1997 |
| EP | 0829844 | A1 | 3/1998 |
| JP | 2008015438 | A | 1/2008 |

OTHER PUBLICATIONS

International Search Report and Written Opinion (PCT/US2009/034681)—entire document.

Automated translation of Publication EP0829844, Nov. 3, 1999, Germany.

* cited by examiner

*Primary Examiner*—Anabel M Ton

(74) *Attorney, Agent, or Firm*—Charles L. Warner; Bryan Cave LLP

(57) ABSTRACT

A plurality of lamp arrays (30A-30N) provide uniform lighting across the copy area of a billboard sign. The arrays (30) are arranged end-to-end horizontally along the length of the copy area. Each array (30) comprises a plurality of LEDs (34A-34N) and a plurality of lenses (36A-36M). The various lenses (36) direct and focus the light from the LEDs (34) at the various parts of the copy area so as to minimize dark and light spots. A "TOP" set of LEDs preferably illuminates the top part of the copy area, a "MIDDLE" set of LEDs preferably illuminates the middle of the copy area, and "FILLER" LEDs preferably serve to illuminate the bottom of the copy area. The lamp arrays are preferably mounted to a catwalk (14) at the bottom of the billboard.

15 Claims, 13 Drawing Sheets

FRONTAL ILLUMINATION OF A SURFACE USING LED LIGHTING

PRIORITY CLAIM

This application claims the priority of U.S. Provisional Patent Application 61/029,952 filed on Feb. 20, 2008, entitled "Frontal Illumination Of A Surface Using Led Lighting" by Todd R. Heller and Dewey T. Pitts. The entirety of the above provisional application is hereby incorporated herein by reference.

BACKGROUND OF THE INVENTION

1. Field of the Invention

The present invention generally relates to lighting of billboards, signs, buildings, and other structures and, more particularly, relates to front illumination of surfaces using light emitting diodes (LEDs).

2. Description of the Related Art

Historically, light fixtures providing front illumination of large advertising billboards have utilized various types of illumination sources, including electro-florescent tubes and flood lights (incandescent, high energy discharge, projection lamps). The illumination source is enclosed in a fixture which is mounted on an extended arm, and the extended arm positions the illumination source, also referred to as a light source, far enough away from the billboard face to illuminate the image area (or "copy area") for viewing in low light conditions. Typically, because of the beamwidth limitations of the light source, two or more light fixtures are needed to illuminate the copy area. The number of light fixtures needed thus depends upon the height and width of the copy area and the beamwidth of the light source. Also, in order to provide the desired dispersion of the light from the light sources, and to provide for relatively even illumination from top to bottom of the copy area, the light sources have to be set back from the billboard face, typically 6 to 8 feet. The fixture mounting system is typically attached to the billboard support structure, either at or near the top of, the bottom of, or both the top and the bottom of, the billboard face. The fixture mounting system therefore typically extends the light fixture in front of the billboard face. The mounting device for each fixture typically consists of a metal tube, arm, or conduit which is mounted to the billboard structure, and which extends out approximately 6 to 8 feet, the light source typically being attached at or near the end of the fixture.

A larger number of light sources provides for more even illumination of the copy area, but generally results in higher costs, more physical structures, higher wind loading, and more maintenance issues. Conversely, a lower number of light sources results in lower cost, fewer physical structures, lower wind loading, and fewer maintenance issues, but increases the likelihood that there will be noticeable and undesirable differences between better lit (lighter) areas and more poorly lit (darker) areas. As a compromise between these opposing goals and choices, a typical installation may use only a few light sources, spaced at intervals of 8 to 12 feet. To compensate for using a small number of light sources, the light sources are generally wide-angle light sources, so that the fields of illumination provided by the light sources overlap somewhat, thereby reducing the contrast between the differently-illuminated areas. The use of wide angle light sources, however, brings on other problems such as, but not limited to, (1) inefficiency because the use of wide-angle light sources causes a substantial amount of the light emitted to be spread outside the borders of the copy area; (2) undesired heat generation because more light output, and therefore more energy, is required so that the light which strikes the copy area is of sufficient intensity to properly illuminate the copy area; and (3) light pollution problems because the light which does not strike the copy area contributes to night sky light pollution. Night sky pollution has become such a severe problem in many large cities that only the brightest stars are visible at night.

Simply replacing the current light sources with LED light sources would seem to be a solution but, in reality, is not a solution because of several problems: (1) a large number of LEDs is required to provide the desired illumination, (2) the optics and lensing required to illuminate the copy area sufficiently is very complex, (3) the heat generated by a large number of LEDs in close proximity or clustered together causes the LEDs to quickly overheat and fail, and (4) cost, windloading, esthetic, maintenance, and other considerations. Thus, neither simply replacing conventional light sources with clustered LEDs, nor adding more projecting fixtures with fewer LEDs in a fixture, are viable options.

DETAILED DESCRIPTION

Figure 1:
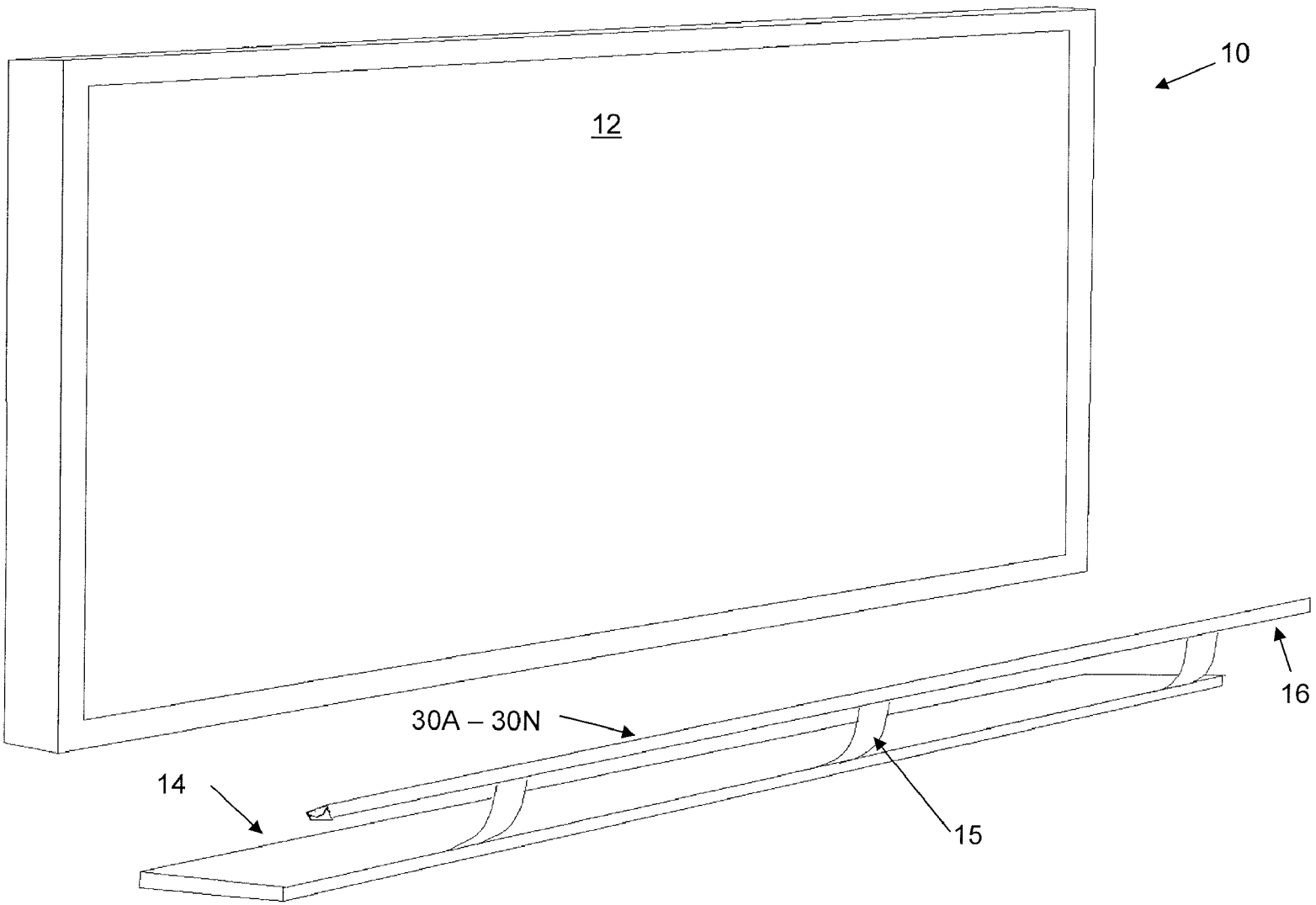
FIG. 1 is an illustration of a billboard and shows the billboard face, the catwalk, and one possible LED lamp location.
Figure 2:
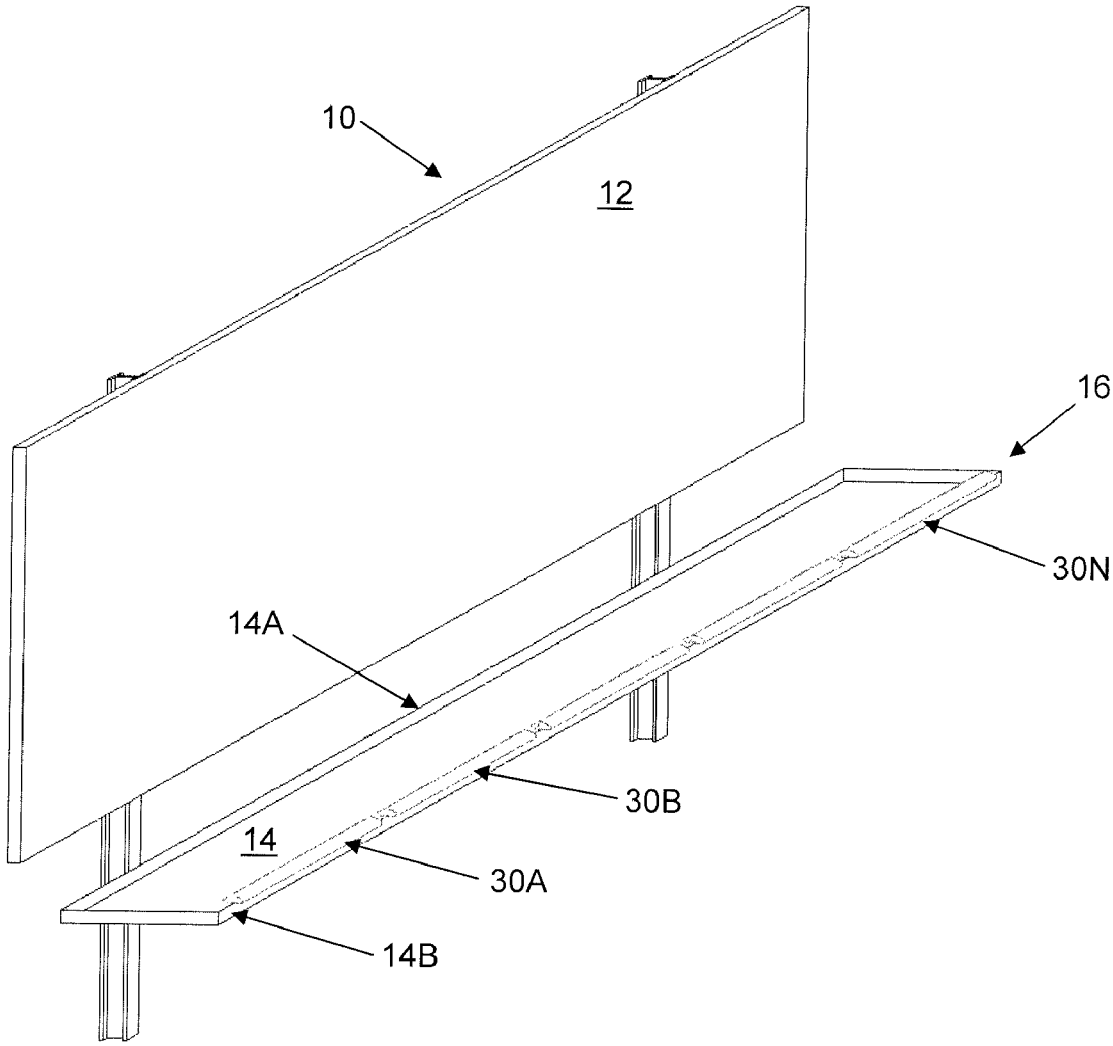
FIG. 2 is an illustration of a billboard and shows the billboard face, the catwalk, and another possible LED lamp location.
Figure 3:
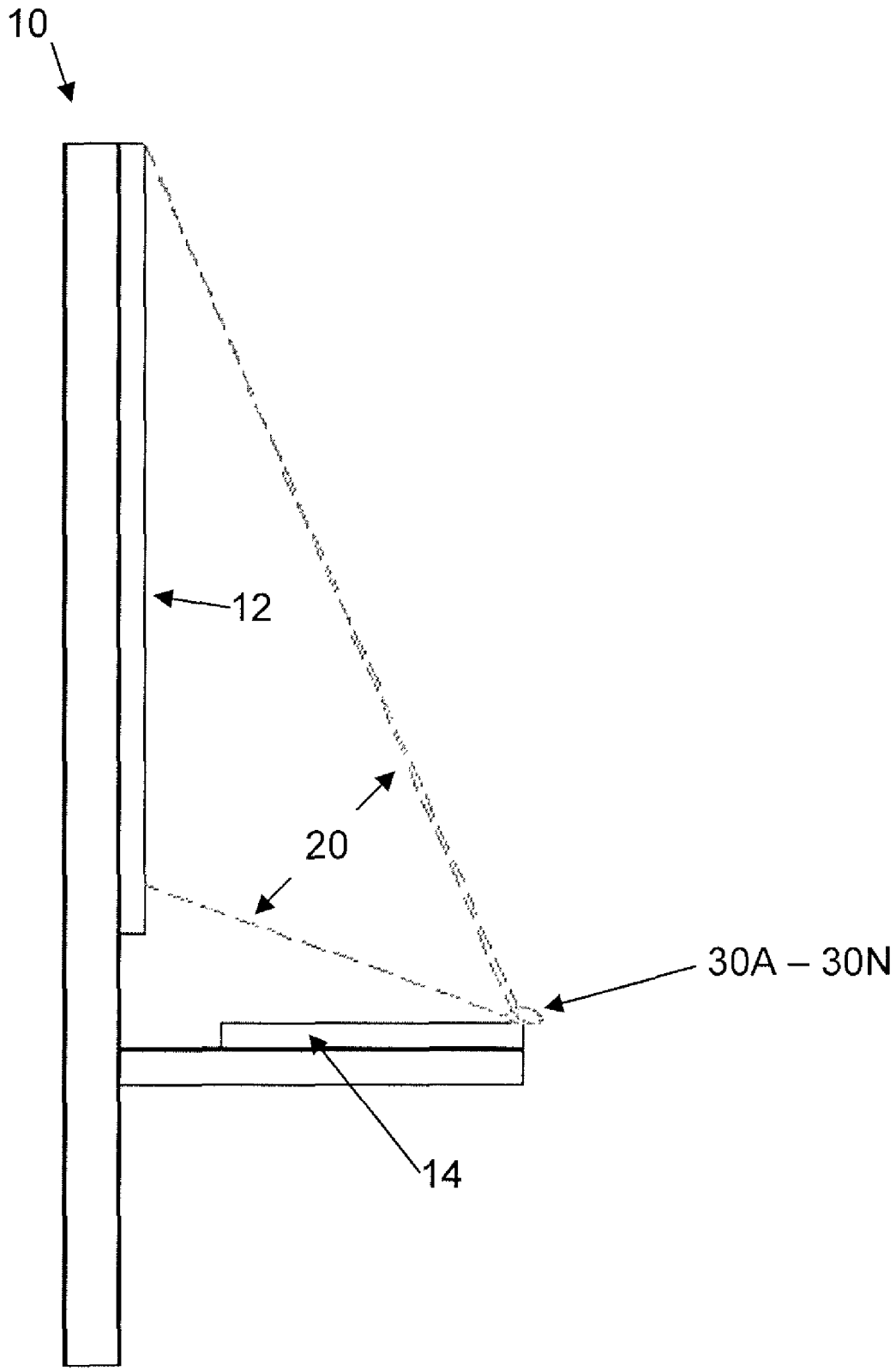
FIG. 3 is an illustration of a billboard and shows the billboard face, the catwalk, another possible LED lamp location, and the preferred light dispersion characteristic.

FIGS. 1-3 illustrate embodiments of various billboard installations and some location possibilities for LED lamp arrays. FIG. 1 is an illustration of one embodiment of a billboard 10 and shows the billboard face 12, the catwalk 14, and one possible location 16 for lamp arrays 30A-30N. FIG. 2 is an illustration another embodiment of a billboard 10, and shows the billboard face 12, the catwalk 14, and another possible location 16 for the lamp arrays 30. FIG. 3 is an illustration of another embodiment of a billboard 10 and shows the billboard face 12, the catwalk 14, another possible location 16 for the lamp arrays 30, and the preferred light dispersion characteristic 20.

The front illuminated sign has a plurality of LED lamp arrays 30A-30N, also referred to herein as light fixtures, preferably mounted to the service access catwalk 14 kickrail, and parallel to the advertising sign face 12. An adjustable mounting bracket 15 accommodates various relationships between the advertising sign face 12 and the location of the service access catwalk 14 toe and kick rails 14A, 14B, such as differences in the locations of the catwalk kickrails in relationship to the sign face. Each LED light fixture is preferably long and rectangular in shape, and has either a single row or multiple rows of LED lamps. The fixtures are mounted on the service access catwalk kickrail, running horizontally along most of the length of the kickrail. Optical lens on the LED lamps selectively and purposefully distribute light vertically and horizontally across the copy area. Preferably, different lens with different light distribution patterns are used for the various LEDs. Even spacing of LED lamps, placed horizontally along the catwalk kickrail, and directed towards the face of the billboard, results in consistent illumination of the copy area.

The illustrated embodiments provide a visually appealing method of illuminating the copy area of a billboard face from the front. There are no protruding light fixtures at the top or the bottom of the billboard. There is no need to obtain extended property line set back permission to accommodate the protruding light fixtures because the LED lights preferably occupy the same latitudinal space as the catwalks present on most billboards. Such catwalks are typically present to provide access for installation and changing of the advertising message, changing light bulbs, general servicing of the billboard, etc. More uniform horizontal illumination can be obtained as a result of evenly spacing LED fixtures along the catwalk kickrail, as opposed to adding and positioning protruding light fixtures. In addition to providing for more even illumination, evenly spacing LED fixtures along the catwalk kickrail eliminates the need for large clusters of LEDs. LED fixtures, especially those intended to be direct replacements for conventional light fixtures typically have large clusters of LEDs, which generate excessive heat build-up, resulting in premature LED failure. The use of the evenly spaced horizontal LED fixtures described herein provides for less power consumption, longer operating lifetimes, cooler operating temperatures, and considerably smaller fixtures than flood lights, electro-fluorescent tubes, or clustered LED fixtures.

The illustrated embodiments provide for front illumination of advertising billboards and other vertical surfaces by using a plurality of horizontally oriented, preferably evenly spaced, LED light fixtures which are mounted to the service access catwalk kickrail parallel to the billboard or sign face.

The illustrated embodiments also provide for an efficient layout of the LEDs, which simplifies cooling and efficiently distributes light in order to illuminate the copy area over a long horizontal distance. The LED fixtures are preferably evenly-spaced horizontally along the front of the sign face, and are preferably mounted in one, two, or three rows to avoid the build-up of heat, which buildup can reduce LED longevity. A buildup of heat is typical of spotlight-type fixtures, including cluster LED fixtures.

In addition, lamp arrays 30A-30N may be stacked so as to achieve more luminosity, and the rows may be offset from one another so as to achieve a more uniform illumination across the copy area.

Figure 4:
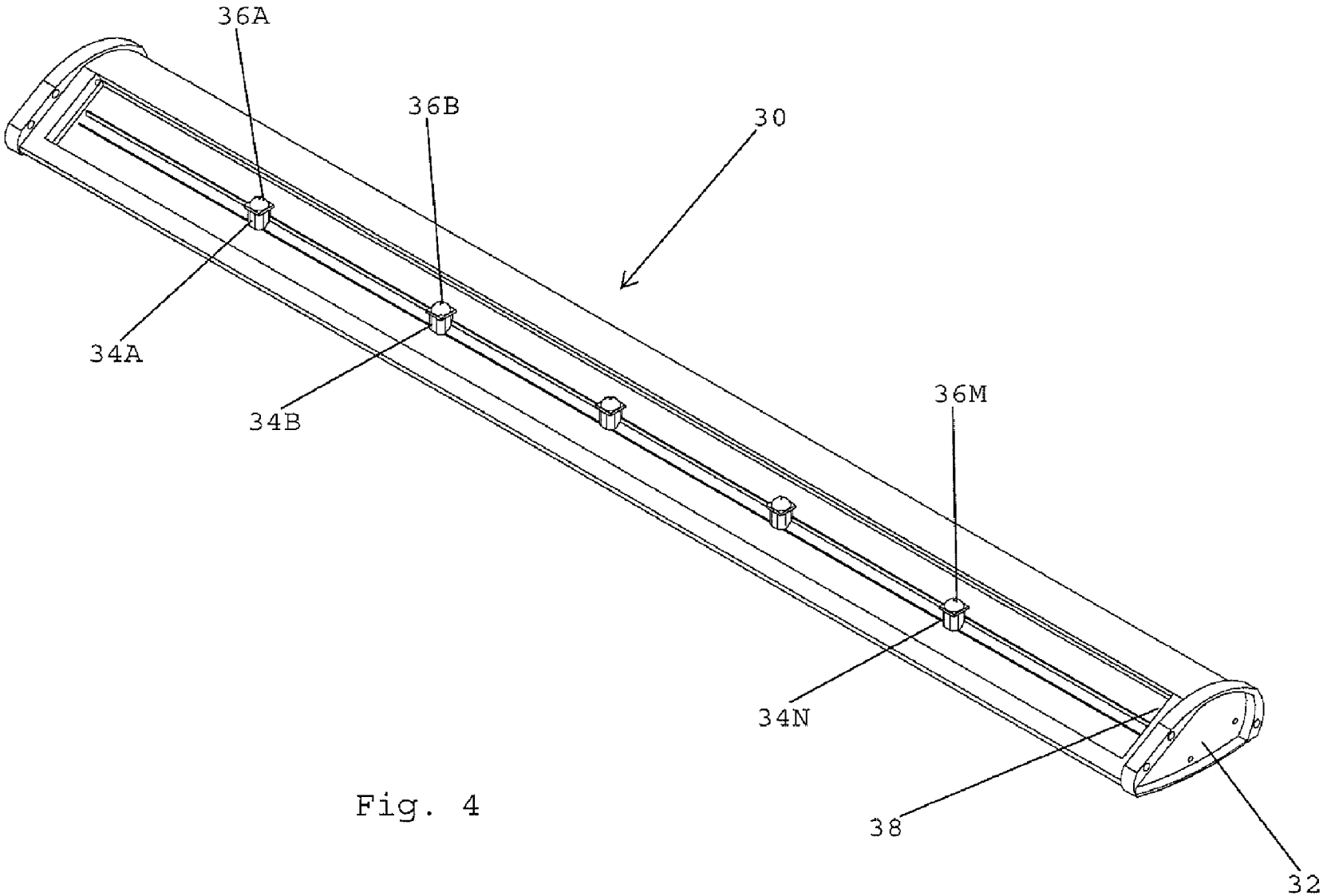
FIG. 4 is an illustration of one embodiment of a lamp array.
Figure 5:
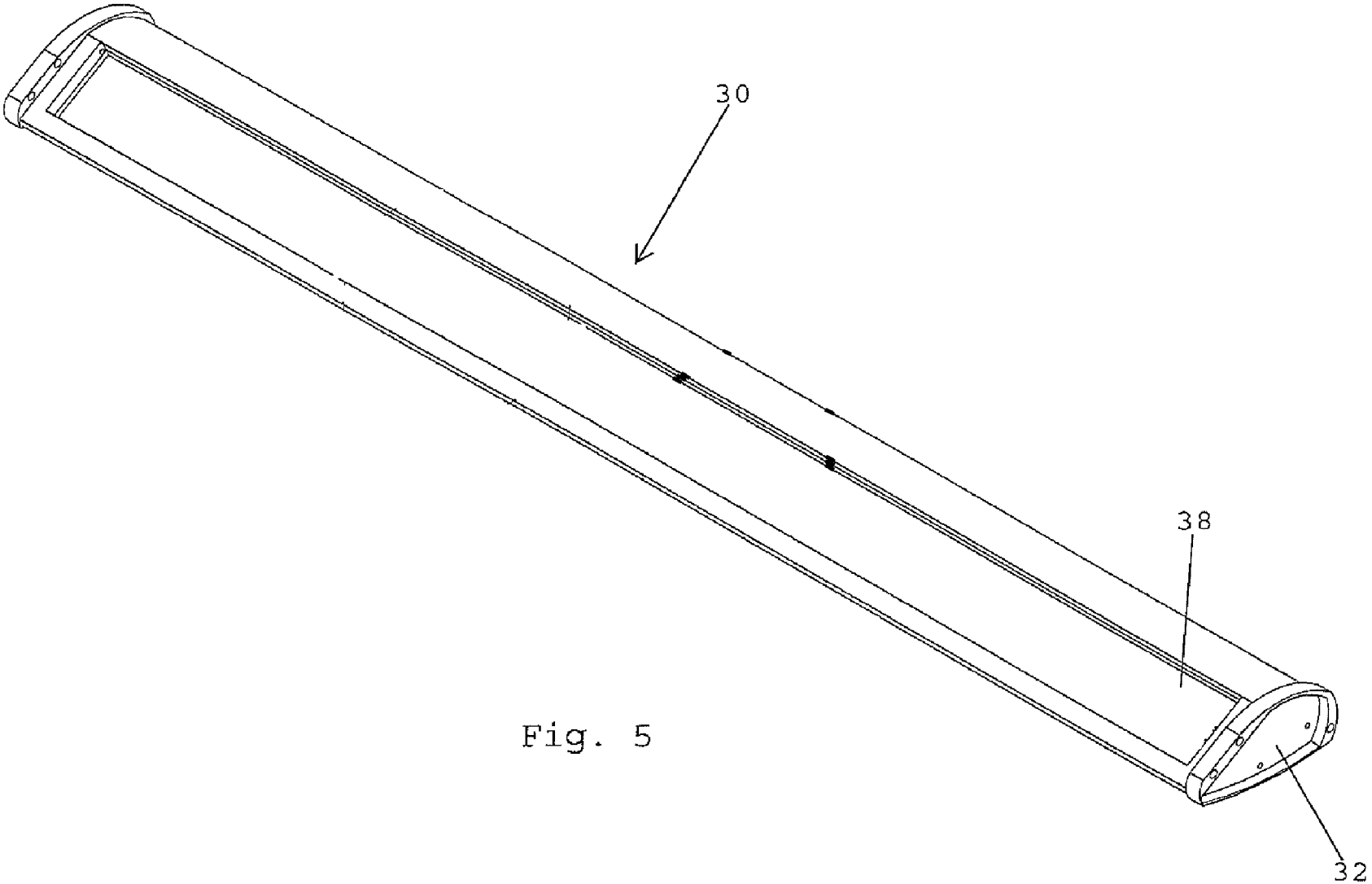
FIG. 5 is an illustration of another embodiment of a lamp array.
Figure 6:
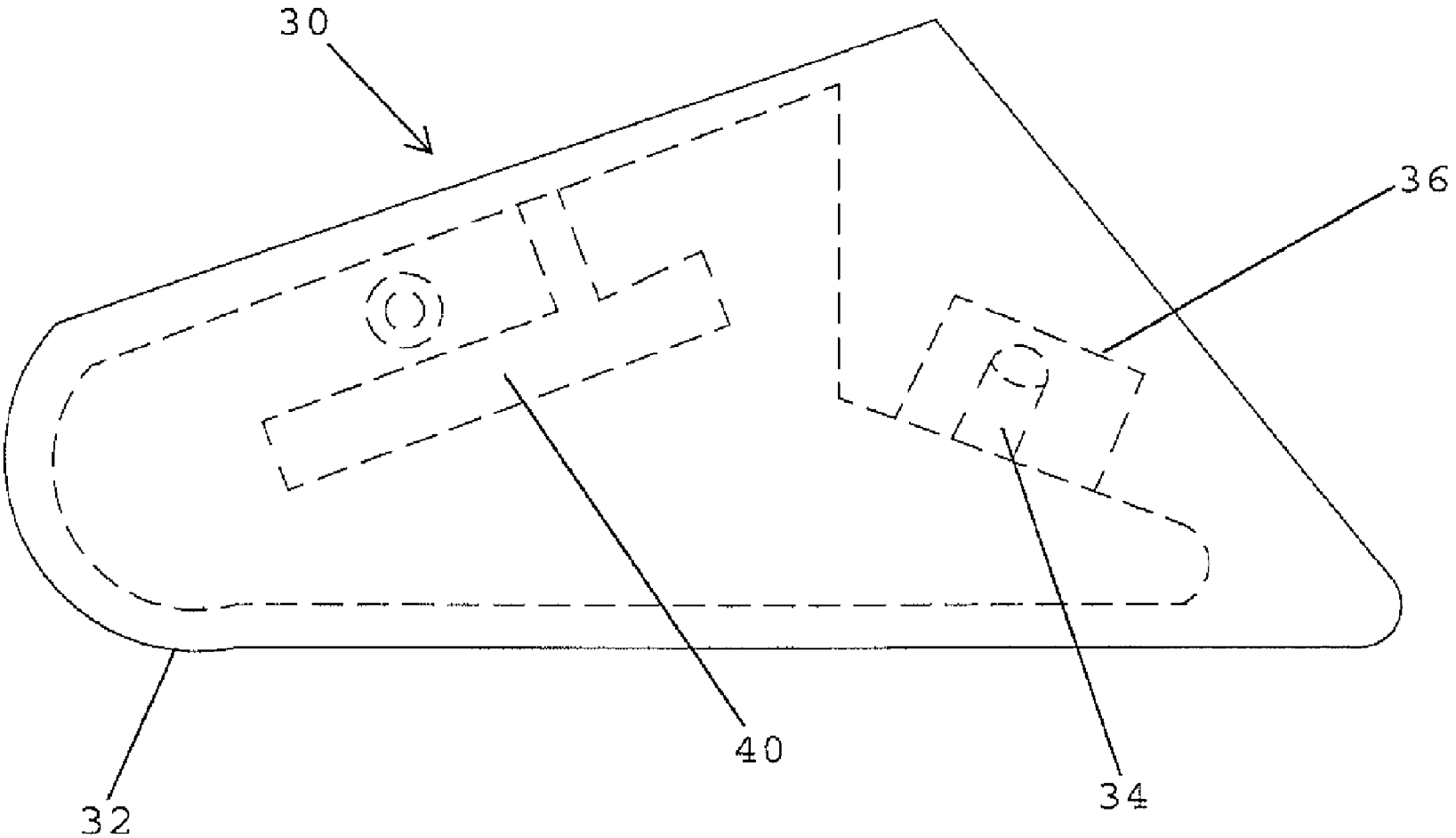
FIG. 6 is a side elevation cutaway view of an embodiment of a lamp array, and shows a typical position for the power supply and an individual LED cell.

FIGS. 4-6 illustrate embodiments of various LED lamp array configurations. FIG. 4 is an illustration of one embodiment of a lamp array 30 and shows a housing 32, a plurality of LEDs 34A-34N and a plurality of lens elements 36A-36M, where M is less than or equal to N, and, preferably, a cover 38 to protect the LEDs 34 and lens 36 from the environment.

FIG. 5 is an illustration of another embodiment of a lamp array 30 and shows a housing 32 and, preferably, a cover 38. The LEDs 34 and lens 36 are present but are not shown in this view.

FIG. 6 is a side elevation cutaway view of the embodiment of the lamp array 30, such as the embodiment of FIG. 4, and shows the housing 32, a typical position for the power supply 40, and one LED 34/lens 36 combination.

Figure 7:
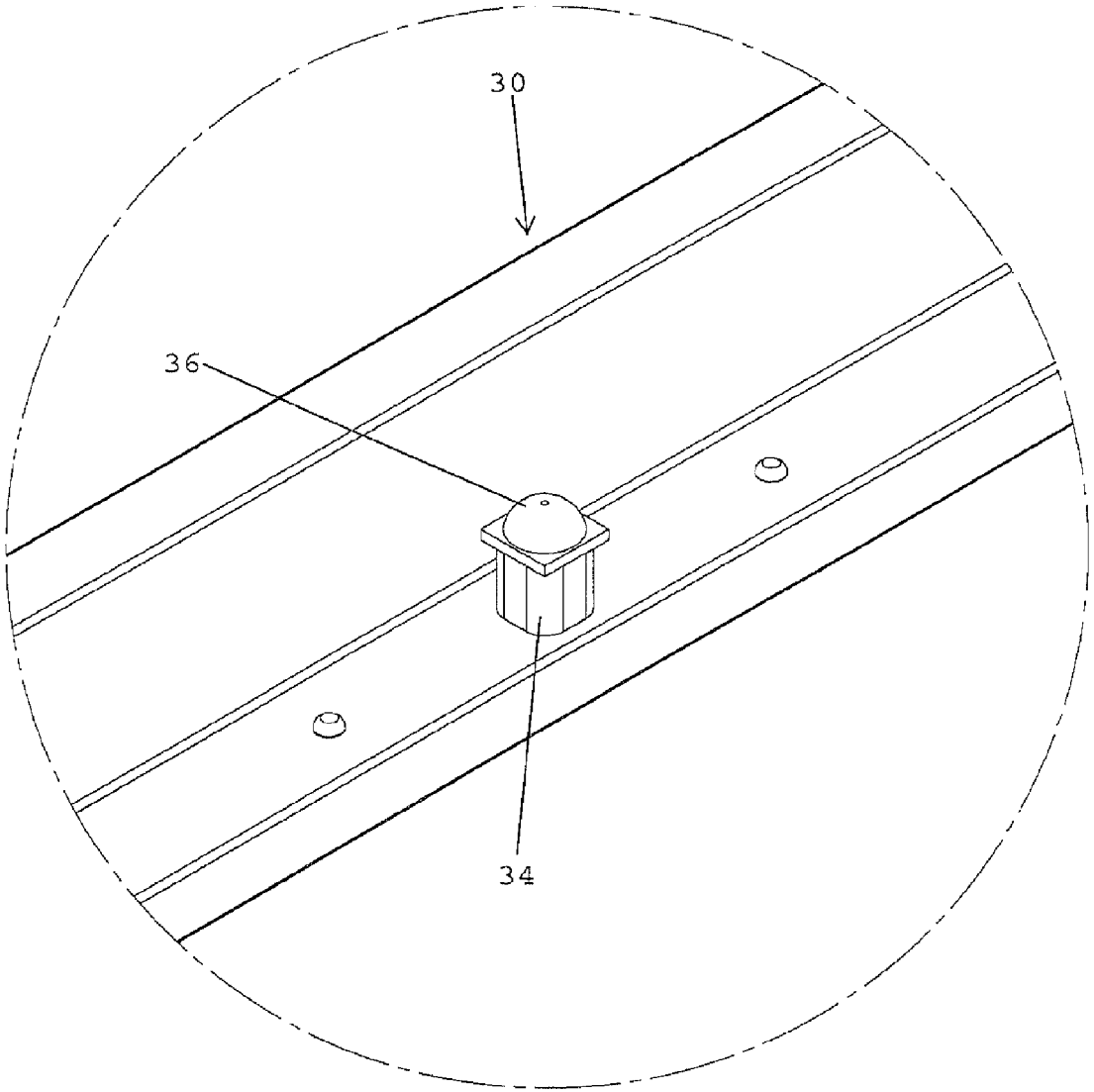
FIGS. 7 and 8 are photographs of an embodiment of a lamp array and show LED cells, both with and without optical lenses.
Figure 8:
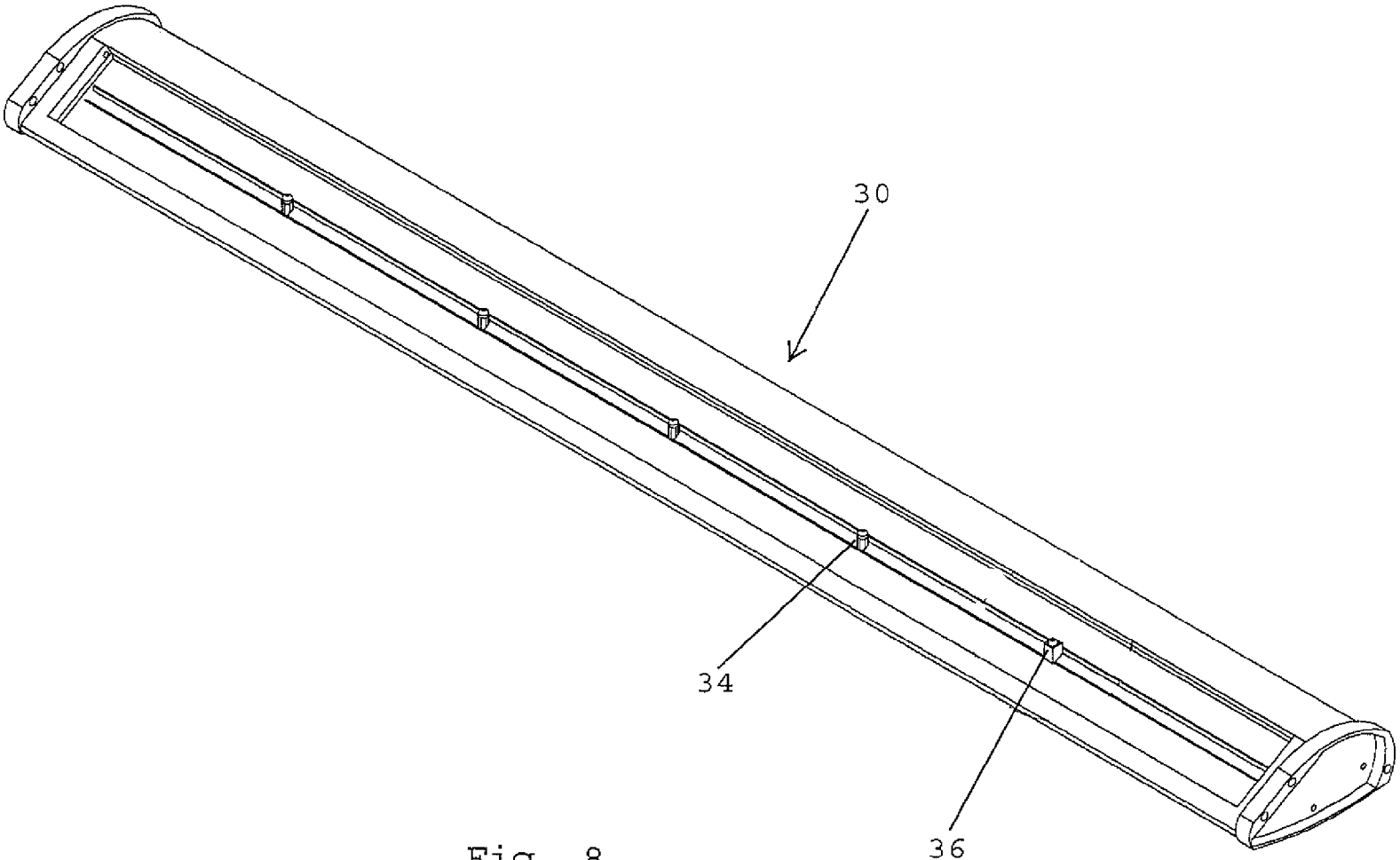

FIGS. 7-10 are photographs of exemplary lamp arrays 30. FIG. 7 shows an exemplary embodiment of a lamp array 30 with an LED cell 34 covered by an optical lens 36. FIG. 8 shows an exemplary embodiment of a lamp array 30 with an LED cell 34 which is not covered by an optical lens.

Figure 9:
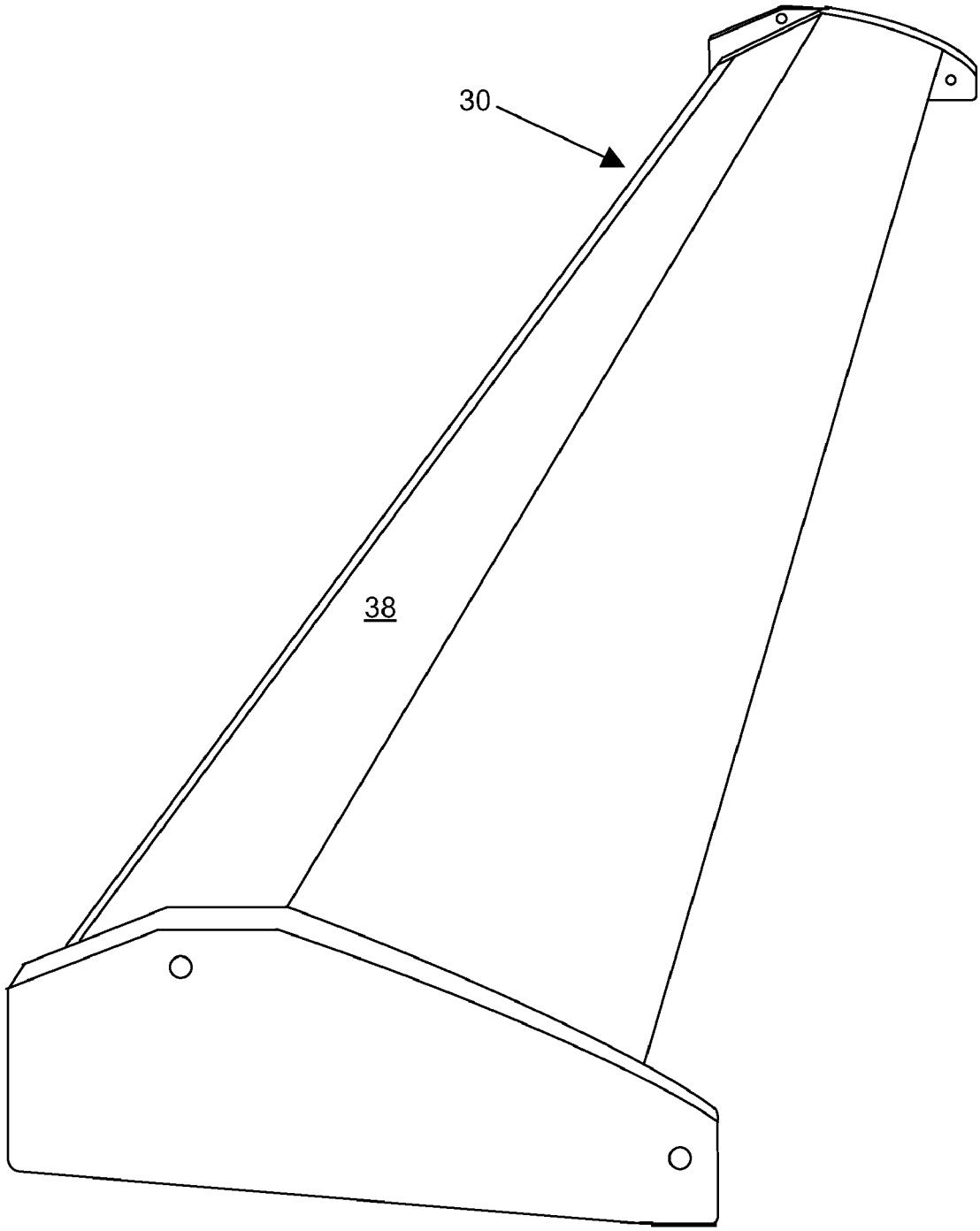
FIGS. 9 and 10 are photographs of an embodiment of a lamp array and show the protective cover in place.
Figure 10:
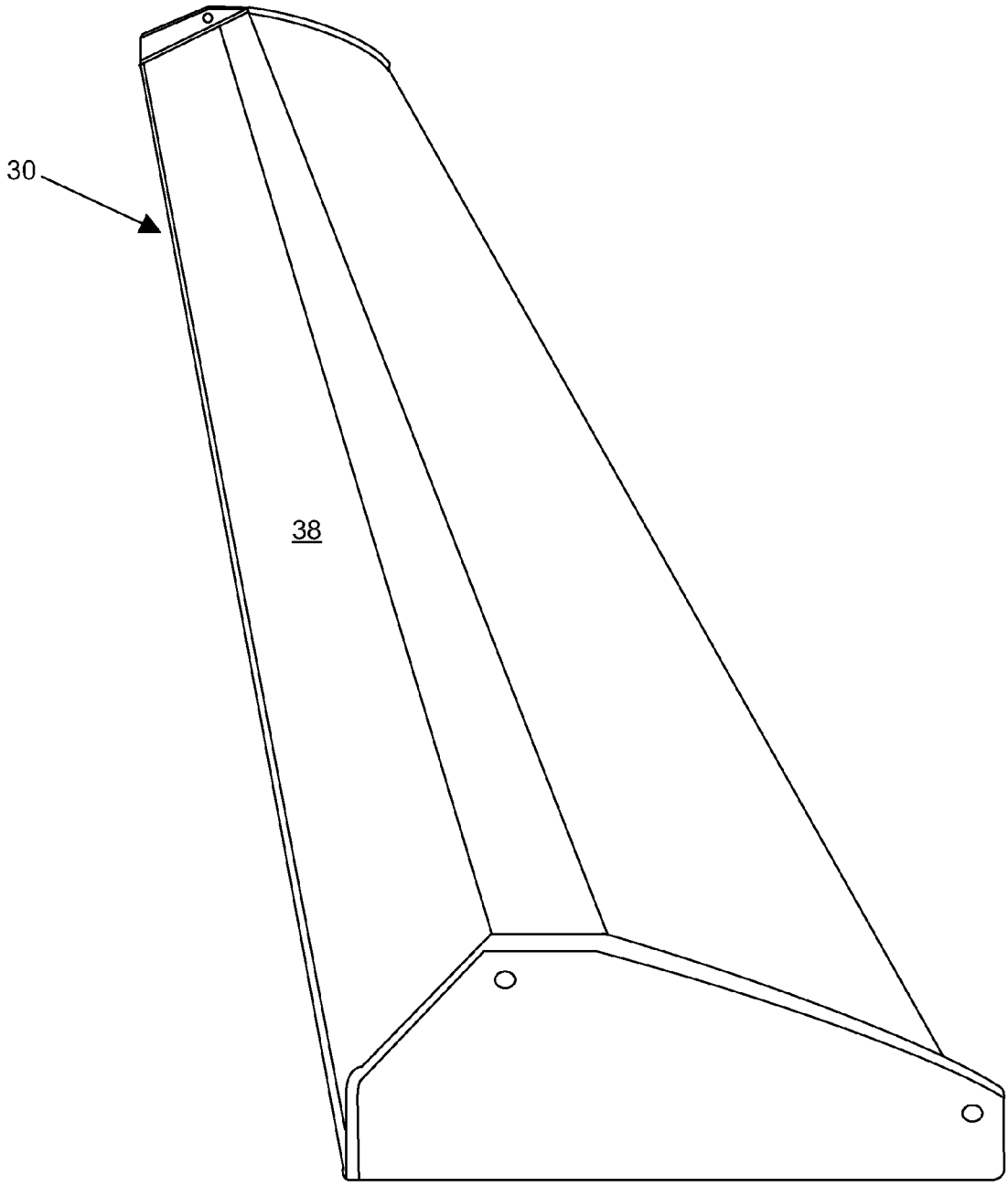

FIGS. 9 and 10 show an exemplary embodiment of a lamp arrays 30 from two different perspectives, and show the protective cover 38 in place.

As shown in FIGS. 1-3, the lamp arrays 30A-30N are lined up, end to end, at the desired position with respect to the catwalk 14, some but not all of which positions are shown. As can be seen, all LEDs 34 of the lamp arrays 30 preferably lie along the same line or axis, and are generally evenly spaced along the length of the catwalk 14. The lamp arrays 30 are preferably mounted just outside the catwalk area 14, which provides for ease of maintenance, such as replacing a cracked protective cover 38.

FIGS. 11A-11E illustrate some exemplary LED cell 34 configurations for a lamp array 30. The LEDs 34 are spaced approximately 4 inches apart, which distance is preferred, but is not critical. The spacing is based on a tradeoff between, for example, the acceptable difference in the illumination levels in adjacent or even non-adjacent sections of the copy area, the minimum amount of lighting required, and the cost tradeoffs between higher power, but fewer, LEDs, and fewer lens, versus lesser power, but more, LEDs, and more lens, etc.

Figure 11A:
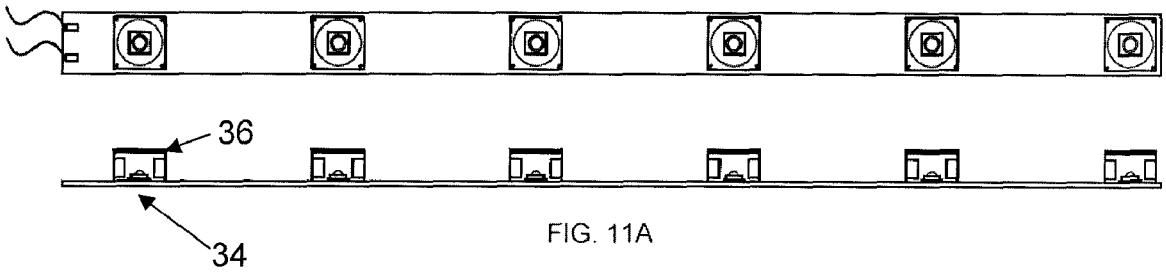
FIGS. 11A-11E are illustration of various LED cell configurations and various optical lensing arrangements.

FIG. 11A illustrates an embodiment wherein lenses 36 are used on all of the LEDs 34. The various lenses 36 may be the same type or may be different types depending upon the uniformity of illumination desired or acceptable, color(s) desired, cost considerations, etc.

It will be appreciated that light from a light source spreads as the light gets farther away from the light source, so an area at one distance will receive a different amount of light than the same size area at a different distance. Further, it will be appreciated that a surface which receives light from a light source shining directly at the surface will have a higher level of illumination per area of surface than if that same surface were turned at an angle to the light source. To compensate for these effects, for example, when the LED arrays are mounted toward the bottom of the billboard face such as on the catwalk, then more of the light is directed toward the upper portion of the copy area, because the upper portion is farther away from the LED arrays than the bottom portion and is at a greater angle with respect to the LED arrays than the bottom portion.

Figure 11B:
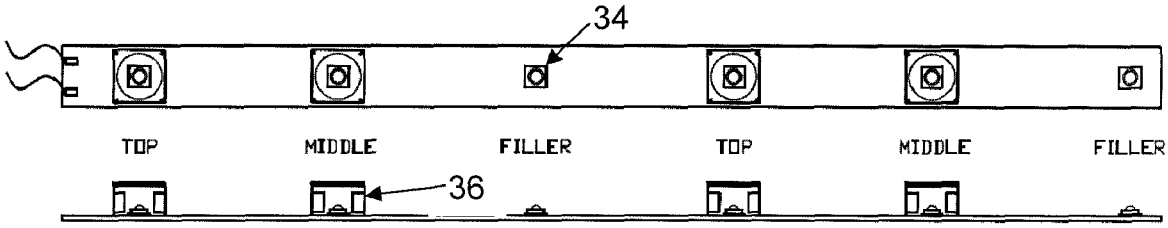

FIG. 11B shows an embodiment wherein different lenses 36 are used on some of the LEDs 34 and, preferably, no lenses are used on other LEDs 34. The designations "TOP", "MIDDLE", and "FILLER" indicate the general vertical position on the copy area where the light from that particular LED 34 strikes the copy area. For example, for a billboard which has a copy area height of approximately 14 feet, a TOP area is preferably, but not necessarily, an oval area, approximately 2.5 feet high by 5 feet wide, the center of this TOP area being approximately 1.25 feet from the top edge of the copy area. A MIDDLE area is preferably, but not necessarily, a circular area, approximately 5 feet high by 5 feet wide, the center of this MIDDLE area being approximately 7 feet from the top edge of the copy area. Although the TOP and MIDDLE areas could overlap, an overlap is not necessary so, in this embodiment, these areas do not overlap. It will be appreciated that the illumination outside of an area does not abruptly fall to zero outside of the area, but tapers off. Thus, a TOP position LED will provide some illumination outside of the TOP area, and a MIDDLE position LED will provide some illumination outside of the MIDDLE area. These outside-area illuminations therefore combine and enhance the uniformity of the illumination.

A "FILLER" (or "BOTTOM") area is preferably, but not necessarily, approximately the bottom half of the copy area, such as from the bottom edge of the copy area to approximately 9 feet from the bottom edge of the copy area. The FILLER area may be determined by focusing the light output from a FILLER LED, such as by using a lens, or may be determined by the characteristics of the particular LED device used. Although the MIDDLE and FILLER areas could overlap, an overlap is not necessary so, in this embodiment, these areas do not overlap. It will be appreciated, as mentioned above, that the illumination outside of an area does not abruptly fall to zero outside of the area, but tapers off.

The TOP and MIDDLE areas are obtained by the use of focusing lenses and, in one embodiment, the focusing lens for a TOP LED has a beamwidth of 23 degrees by 50 degrees, and the focusing lens for a MIDDLE LED has a beamwidth of 45 degrees. The FILLER LED preferably, but not necessarily, does not use a focusing lens. As used herein, the term "focus" is not limited to the narrowing of a beam of light from an LED but also includes broadening of a beam and adjusting the pattern of a beam.

In operation of a preferred embodiment, the TOP LEDs will illuminate the uppermost portions of the copy area. Preferably, the illumination footprints provided by the TOP LEDs in the same lamp array will overlap, and the illumination footprints provided by the TOP LEDs in adjacent arrays will overlap. The MIDDLE LEDs will illuminate the middle portions of the copy area. Also, preferably, the illumination footprints provided by the MIDDLE LEDs in the same lamp array will overlap, the illumination footprints provided by the MIDDLE LEDs in adjacent arrays will overlap. The FILLER LEDs preferably illuminate at least the bottom portion of the copy area. Preferably, the illumination footprints provided by the FILLER LEDs in the same lamp array will overlap, and the illumination footprints provided by the FILLER LEDs in adjacent arrays will overlap. The overlap, or near overlap, between different footprints serves to make the illumination more uniform across the billboard and to reduce contrast between adjacent areas. Too little overlap can cause darker areas to appear, while too much overlap can cause brighter areas to appear, as well as increasing the cost of operation.

Figure 11C:
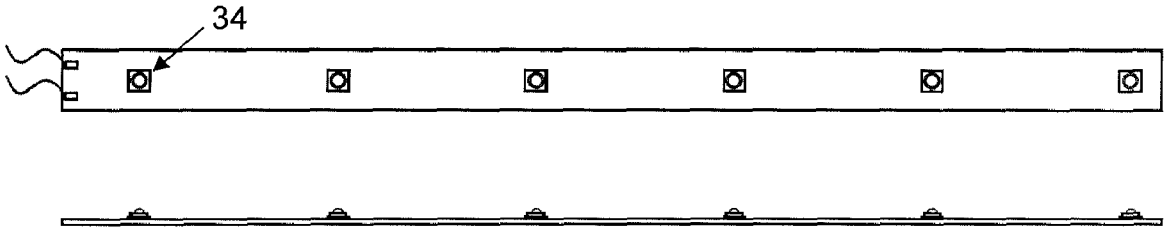

FIG. 11C is an illustration of one LED cell configuration, such as might be used in FIGS. 11A and 11B, but without the lenses.

Figure 11D:
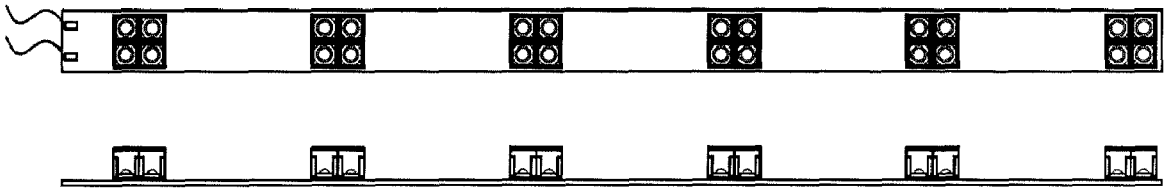
Figure 11E:
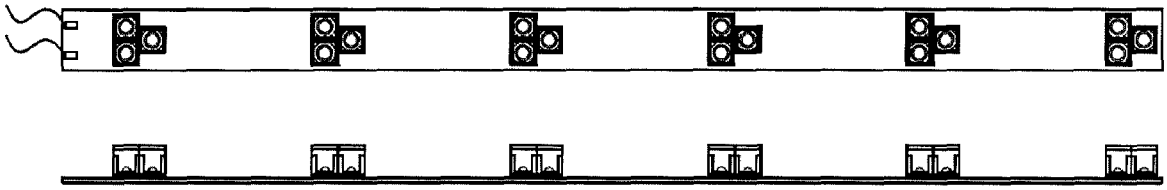

FIGS. 11D and 11E show two alternative LED cell configurations wherein the LEDs are grouped. One situation in which these configurations may be used is, for example, when additional lighting is required so that the billboard face can be seen from a greater distance or in conditions other than near or total darkness. Another situation in which they may be used is, for example, to provide different colors or color effects. For example, all LEDs in a group may have the same color (but preferably different lens), and different groups may have different colors. As another example, the LEDs in a group may have different colors (and preferably similar or identical lens), and different groups may have lens with different characteristics.

In one embodiment, the LEDs are type Xlamp™ XR-E manufactured by Cree™ of Durham, N.C., and have an output of 100 Lumens at 350 milliamps (ma). These LEDs are rated at a current input of up to 1000 ma and, in one embodiment, the current input is 950 ma, which provides a light output of 180 Lumens. In another embodiment, the LEDs are type XLamp 7090 XR, also manufactured by Cree.

In one embodiment, such as when the above-mentioned Cree LEDs are used, the lens is an "FC Lens", sold by Fraen™ Corporation, Reading, Mass. In another embodiment, the lens is a "CRS Square Lenses", for CREE XR-E LEDs, sold by Marubeni America™ Corporation, Santa Clara, Calif. In one embodiment, the lens used for the "TOP" position LEDs is a type CRS-O manufactured by Ledil Oy™, Salo, Finland, which has a vertical beamwidth of 28 degrees and a horizontal beamwidth of 12 degrees, and the lens used for the "MIDDLE" position LEDs is a type FC-W2-XR79-HRF manufactured by Fraen Corporation, and has a beamwidth (horizontal and vertical) of 41 degrees.

In another embodiment, rather than there being a single row of LEDs in a lamp array 30, there are two or more rows of LEDs in an array. The LEDs in the different rows may be in a vertical column, or they may be offset, if desired, so as to further and more evenly distribute the light shining on the copy area. For example, FIG. 11D shows a lamp array which has two rows of LEDs in a vertical column, and FIG. 11E shows a lamp array which may be considered to have three rows, the center row being offset horizontally from the other two rows. Other embodiments are also possible such as, for example, where the top row in FIG. 11D is offset, with respect to the bottom row, by one-half of the distance between the elements in the bottom row.

Although the embodiments are depicted on billboards which have catwalks, the LED arrays can also be used on billboards which do not have catwalks. One could use, for example, a plurality of mounting arms to support the arrays. One could also, for example, provide a railing, set out from the bottom of the billboard, and held in place by a plurality of mounting arms, and fasten the arrays to the railing. Also, although the embodiments shown have the LED arrays mounted toward the bottom of the billboard, pointing generally upwardly, the LED arrays can, instead, be mounted toward the top of the billboard, and generally pointing downward. Top mounting of the arrays may be accomplished, for example, by a plurality of mounting arms as mentioned above, or by a railing set out from the top billboard and held in place by a plurality of mounting arms. Also, if there are two billboards which are stacked, then the arrays could be mounted to the catwalk of the upper billboard and, in this case, the catwalk on the upper billboard may serve for mounting of the light arrays for both the upper billboard and the lower billboard. In addition, if exceptional uniformity of illumination is desired, or if exceptional luminance is desired, then two sets of LED arrays could be used, one mounted toward the bottom of the billboard, pointing generally upwardly, and the other mounted toward the top of the billboard, and generally pointing downward.

For convenience of discussion below, it is assumed that the copy area has a size of 12 feet×24 feet. Thus, the copy area could be considered to be a 12 foot by 24 foot matrix of light surfaces. Also for convenience, Table I and Table II have both been broken into two table segments, with the top segment of the table representing the left one-half of the copy area, and the bottom part representing the right one-half of the copy area.

Table I shows the illumination across a 12 foot by 24 foot panel, which is illuminated by a typical four-projection arm and light source array. The total power provided to the four High Intensity Discharge lamps (HID) is 432 watts (3.6 amps at 120 VAC), and the four arrays produce an illumination of 42,000 Lumens. The panel is divided into 1 foot squares, but measurements were not taken on the leftmost, rightmost, topmost, or bottommost squares. Accordingly, measurements were conducted on 220 (10×22) squares. The numbers show the illumination in foot-candles for each square and are actual measurements, except that the values for squares A6-A22, B6-B22, and C16-C22 are estimates. From this, it can be seen that the total copy area illumination is 11152 footcandles, the average illumination is 50.60 footcandles, and the low and high illuminations are 16 and 124 footcandles, respectively. As the arrays produce 42000 lumens, and only 11152 lumens strike the board, this means that up to 30848 lumens are not used, contributing nothing to the illumination of the copy area, but contributing to night sky pollution. In other words, only about 26.55% of the illumination strikes the copy area, and the other 73.45% is effectively wasted.

Table II similarly shows the illumination across a 12 foot by 24 foot panel, which is illuminated by an embodiment using LEDs. The total power provided to the LEDs is 240 watts (2.0 amps at 120 VAC), and the LEDs produce an illumination of 13,500 Lumens. The numbers show the illumination in foot-candles for each square and are actual measurements, except that the values for squares A6-A22, B6-B22, and C6-C22 are estimates. From this, it can be seen that the total copy area illumination is 10747.6 footcandles, the average illumination is 48.85 footcandles, and the low and high illuminations are 12.6 and 99 footcandles, respectively. As the arrays produce 13500 lumens, and 10747.6 lumens strike the board, this means that only 2752.4 lumens are not used. In other words, about 79.61% of the illumination strikes the desired areas of the copy area, and only 20.39% is wasted.

Therefore, the efficiency of the LED fixture, as compared to the High Density fixture, has been increased almost three-fold, from 26.55% to 79.61%. Further, the power consumption has been reduced by over 40% but the total light striking the copy area has decreased by less than 4%.

Figure 12:
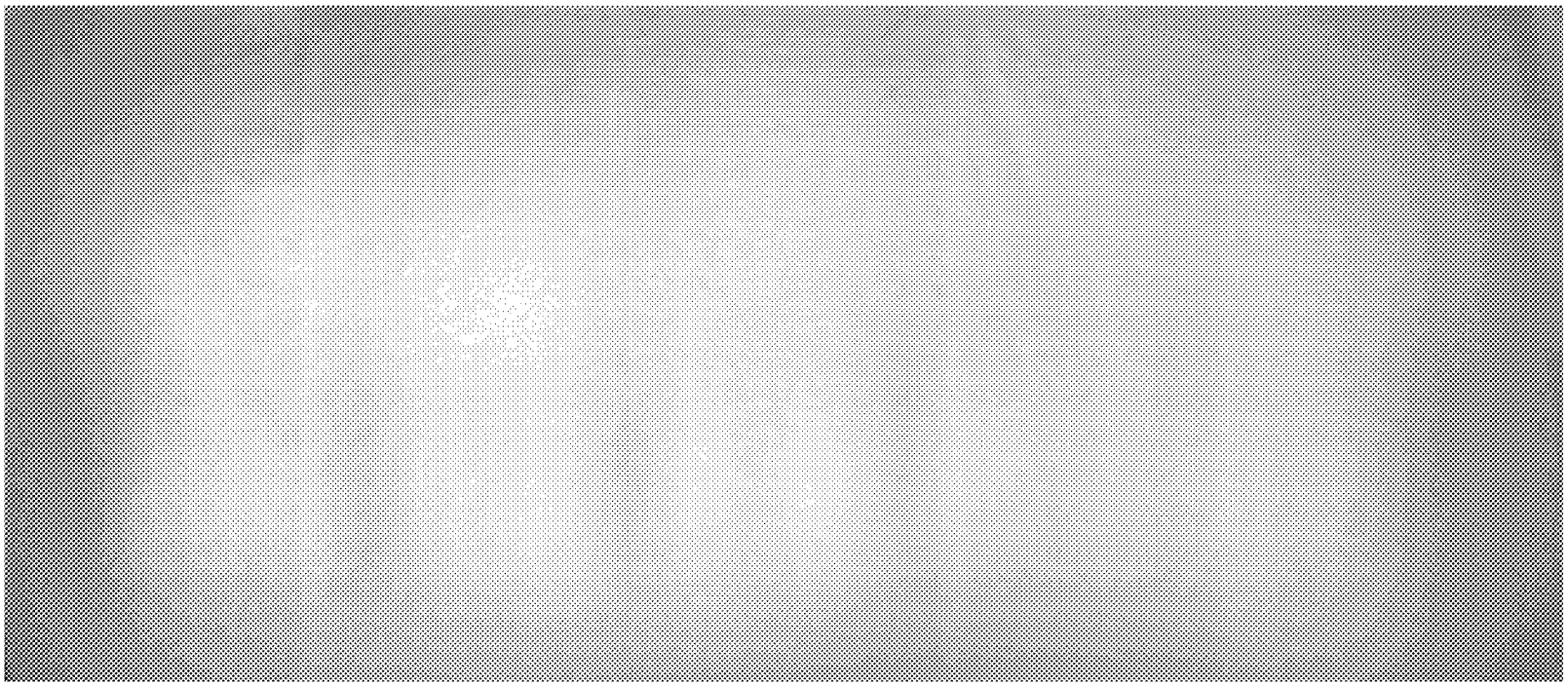
FIG. 12 is a photograph showing the light distribution provided by the LED lamp array of one embodiment.

FIG. 12 is a photograph showing the light distribution provided by the LED lamp array of one embodiment.

Figure 13:
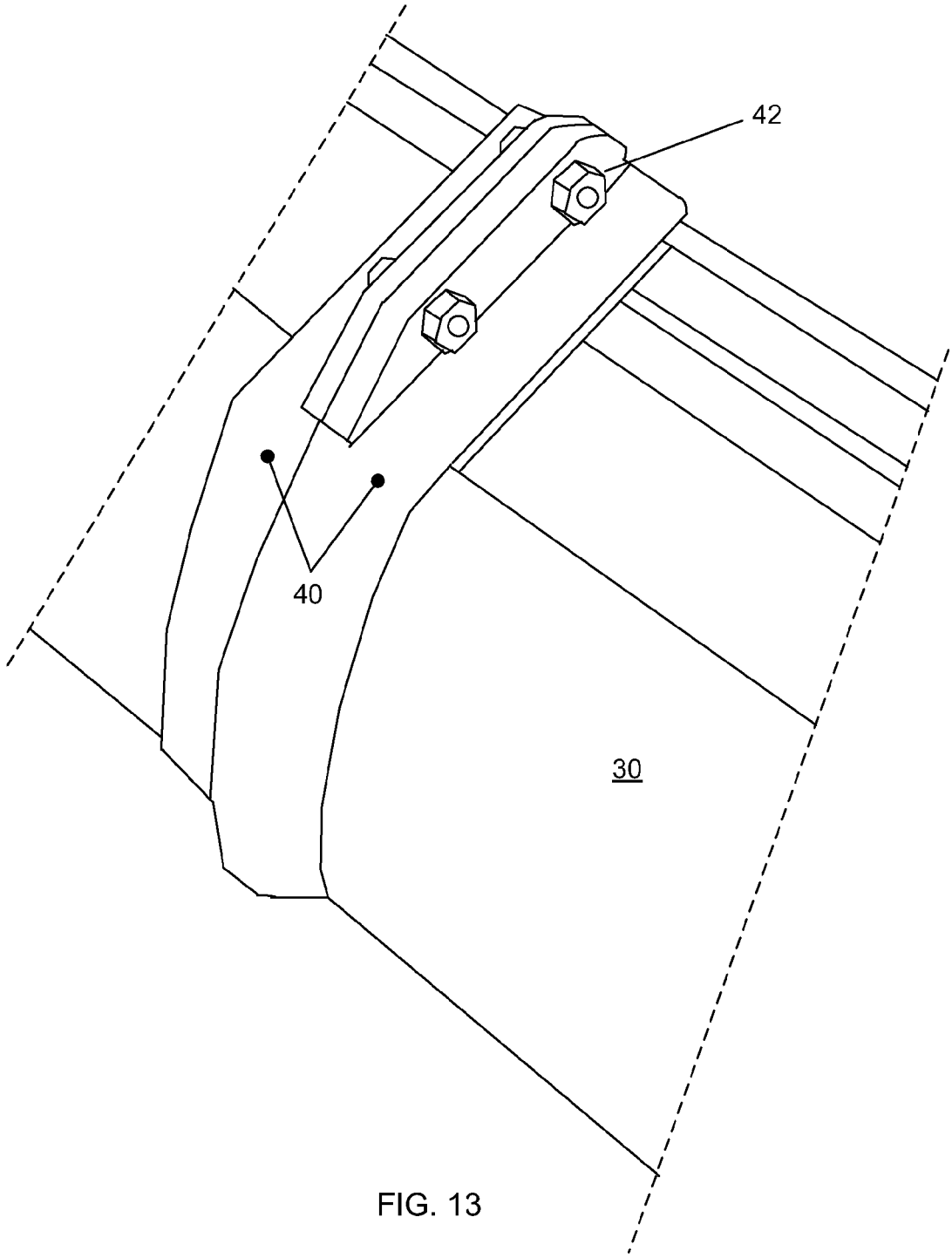
FIG. 13 is a photograph illustrating one method of connecting lamp arrays.

FIG. 13 is a photograph illustrating one method of connecting lamp arrays 30 in an end-to-end configuration. The lamp arrays 30 have end caps 40, and are held together by mounting hardware 42, such as, but not limited to, a bolt and a nut. The method of connecting the lamp arrays 30 is not critical and other techniques may be used.

TABLE I

HID LIGHTING

| | 1 | 2 | 3 | 4 | 5 | 6 | 7 | 8 | 9 | 10 | 11 |
|---|---|---|---|---|---|---|---|---|---|---|---|
| A | 18 | 21 | 23 | 26 | 28 | 28 | 29 | 32 | 32 | 31 | 30 |
| B | 19 | 24 | 28 | 31 | 36 | 37 | 36 | 39 | 41 | 40 | 38 |
| C | 20 | 26 | 33 | 39 | 43 | 46 | 46 | 48 | 50 | 50 | 49 |
| D | 19 | 25 | 36 | 46 | 51 | 57 | 58 | 57 | 60 | 61 | 58 |
| E | 19 | 26 | 35 | 45 | 60 | 67 | 72 | 69 | 69 | 70 | 67 |
| F | 17 | 24 | 33 | 49 | 62 | 73 | 78 | 82 | 80 | 80 | 77 |
| G | 16 | 20 | 29 | 41 | 61 | 72 | 79 | 85 | 93 | 100 | 103 |
| H | 17 | 21 | 27 | 35 | 48 | 66 | 73 | 83 | 101 | 114 | 124 |
| I | 19 | 22 | 29 | 35 | 44 | 54 | 69 | 82 | 98 | 107 | 109 |
| J | 18 | 23 | 28 | 38 | 41 | 49 | 47 | 60 | 82 | 95 | 86 |

| | 12 | 13 | 14 | 15 | 16 | 17 | 18 | 19 | 20 | 21 | 22 |
|---|---|---|---|---|---|---|---|---|---|---|---|
| A | 30 | 31 | 32 | 32 | 29 | 28 | 28 | 26 | 23 | 21 | 18 |
| B | 38 | 40 | 41 | 39 | 36 | 37 | 36 | 31 | 28 | 24 | 19 |
| C | 49 | 50 | 50 | 48 | 46 | 46 | 43 | 39 | 33 | 25 | 20 |
| D | 58 | 61 | 60 | 57 | 58 | 57 | 51 | 46 | 36 | 25 | 19 |
| E | 67 | 70 | 69 | 69 | 72 | 67 | 60 | 45 | 35 | 26 | 19 |
| F | 77 | 80 | 80 | 82 | 78 | 73 | 62 | 49 | 33 | 24 | 17 |
| G | 103 | 100 | 96 | 85 | 79 | 72 | 61 | 41 | 29 | 20 | 16 |
| H | 124 | 114 | 101 | 83 | 73 | 66 | 48 | 35 | 27 | 21 | 17 |
| I | 109 | 107 | 98 | 82 | 69 | 54 | 44 | 35 | 29 | 22 | 19 |
| J | 86 | 86 | 95 | 82 | 60 | 47 | 49 | 41 | 38 | 26 | 23 |

TABLE II

LED LIGHTING

| | 1 | 2 | 3 | 4 | 5 | 6 | 7 | 8 | 9 | 10 | 11 |
|---|---|---|---|---|---|---|---|---|---|---|---|
| A | 16.5 | 18 | 19 | 25 | 31.6 | 31.6 | 31.6 | 31.6 | 31.6 | 31.6 | 31.6 |
| B | 19.9 | 21.5 | 24.3 | 30 | 39.5 | 39.5 | 39.5 | 39.5 | 39.5 | 39.5 | 39.5 |
| C | 25.9 | 29.9 | 32.4 | 39.5 | 49 | 49 | 49 | 49 | 49 | 49 | 49 |
| D | 33.8 | 39.3 | 44.6 | 51.8 | 60.7 | 62 | 66 | 60 | 50 | 57 | 64 |
| E | 41.7 | 50.7 | 53.8 | 57 | 71.7 | 71 | 71 | 62 | 53 | 65 | 76 |
| F | 39.1 | 50.1 | 59.2 | 65.6 | 74.5 | 80.1 | 79 | 65 | 60 | 76 | 83 |
| G | 27.7 | 38 | 50 | 62 | 70 | 82 | 84 | 70 | 66 | 83 | 92 |
| H | 21.3 | 33.8 | 43.6 | 53.1 | 63.2 | 77 | 84 | 67 | 63.5 | 87.3 | 94.1 |
| I | 17.6 | 30.3 | 41.8 | 45.8 | 47.6 | 54 | 57 | 80 | 48 | 69 | 68 |
| J | 13 | 20 | 26 | 27 | 27 | 29 | 29 | 27 | 29 | 34 | 37 |

| | 12 | 13 | 14 | 15 | 16 | 17 | 18 | 19 | 20 | 21 | 22 |
|---|---|---|---|---|---|---|---|---|---|---|---|
| A | 31.6 | 31.6 | 31.6 | 31.6 | 31.6 | 31.6 | 31.6 | 25 | 19 | 18 | 16.5 |
| B | 39.5 | 39.5 | 39.5 | 39.5 | 39.5 | 39.5 | 39.5 | 30 | 24.3 | 21.5 | 19.9 |
| C | 49 | 49 | 49 | 49 | 49 | 49 | 49 | 39.5 | 32.4 | 29.9 | 25.9 |
| D | 63 | 55 | 57 | 64 | 62 | 53 | 46 | 45 | 44 | 34 | 16.5 |
| E | 72 | 61 | 65 | 68 | 66 | 58 | 51 | 53 | 50 | 40 | 17 |
| F | 78 | 65 | 71.2 | 74 | 73 | 64 | 53 | 56 | 57 | 41 | 18 |
| G | 87 | 71 | 80 | 81 | 80 | 72 | 65 | 63 | 64 | 49 | 17.8 |
| H | 99 | 70.1 | 82 | 84 | 78 | 69.9 | 66.8 | 65.5 | 65.1 | 47.9 | 18.6 |
| I | 71 | 58 | 59 | 60 | 61 | 57 | 58 | 56 | 54 | 38 | 16 |
| J | 35 | 32 | 31 | 34 | 34 | 34 | 35 | 37 | 34 | 25 | 12.6 |

It will be appreciated that the individual LEDs may be individually focused onto the copy area at the desired location and with the desired beamwidth. It will also be appreciated that if top mounting of the light array is desired, then some mounting mechanism must be provided to replace the catwalk used for bottom mounting of the light array. Even in such a case, however, the light array will still be closer to the copy area than in conventional technology, and there will not be the long projection arms used by conventional technology.

The housing may be secured to the catwalk, or to another available mounting surface, by any convenient technology, such as, but not limited to, bolts, clamps, straps, and welding. Also, although not shown, it will be appreciated that electrical power must be provided to the light arrays in some manner, such as by conventional wiring.

In addition to billboards, the LED arrays may be used to illuminate the side of a building, such as for esthetic purposes. The LED arrays can be, if desired, mounted using supports extending from the sides of the building, or may be mounted on, for example, existing ledges of the building. The LED arrays may also be used to light highway and roadway signs, from above or from below, or both.

Various advantages and benefits result from the above. Although each embodiment provides at least one advantage or benefit, there is no requirement that any embodiment must provide all benefits, as tradeoffs are to be expected. Therefore, it is expected that one of ordinary skill in the art can and will choose among the various characteristics and features of the various embodiments to achieve the desired illumination result.

The invention claimed is:

1. An apparatus for illuminating substantially all of a desired surface, the desired surface having an upper area, a middle area, and a bottom area, the apparatus comprising:

a plurality of light arrays, the light arrays being arranged end-to-end and generally parallel to the surface, each light array comprising:

a housing;

a first light emitting diode (LED), with an associated lens, to primarily illuminate a portion of the upper area of said surface with a first predetermined pattern, said first LEDs of said light arrays illuminating substantially all of the upper area;

a second LED, with an associated lens, to primarily illuminate a portion of the middle area of said surface with a second predetermined pattern, the second predetermined pattern being different from the first predetermined pattern, said second LEDs of said light arrays illuminating substantially all of the middle area; and a third LED to illuminate at least a portion of the bottom area of said surface, said third LEDs of said light arrays illuminating substantially all of the bottom area.

2. The apparatus of claim 1 wherein the surface is the copy area on a billboard, and the billboard has a catwalk extending from the front thereof, and wherein the light arrays are directly mounted to, and are in close proximity to, either the catwalk or a kickrail of the catwalk.

3. The apparatus of claim 1 wherein the surface is the copy area on a billboard, and the billboard has a catwalk extending from the front thereof, and further comprising at least one mounting bracket for securing a lighting array to, and in close proximity to, either the catwalk or a kickrail of the catwalk.

4. A method for illuminating substantially all of a desired surface, the desired surface having a higher part, a central part, and a lower part, the method comprising:

generating light by providing operating power to a plurality of light arrays, the light arrays being arranged in end-to-end and generally parallel to the surface, each light array comprising a plurality of light emitting diodes (LEDs) which are generally evenly distributed within the light array along a line generally parallel to the surface, the light from each light source being oriented generally toward the surface; and focusing the light from a first set of said LEDs onto the higher part of the surface, the light from each LED being independently focused in a first predetermined shape, the light from the first set of LEDs illuminating substantially all of the higher part;

focusing the light from a second set of said LEDs onto the central part of the surface, the light from each LED being independently focused in a second predetermined shape, said second predetermined shape being different from said first predetermined shape, the light from the second set of LEDs illuminating substantially all of the central part; and directing the light from a third set of said LEDs onto at least a lower part of the surface, the light from the third set of LEDs illuminating substantially all of the lower part.

5. A light array for illuminating substantially all of a desired surface, comprising:

a housing;

a plurality of light emitting diodes (LEDs) contained within the housing and being generally evenly distributed within the housing along a line generally parallel to the surface, each LED of the plurality of LEDs being oriented generally toward the desired surface; and a plurality of lenses contained with the housing, the plurality of lenses covering at least a majority of the LEDs, each lens of the plurality of lenses being associated with an LED of the plurality of LEDs and focusing the light from the associated LED toward a predetermined portion of the desired surface;

a first set of said lenses focusing light primarily onto a first part of the desired surface so that substantially all of the first part is illuminated;

a second set of said lenses focusing light primarily onto a second part of the desired surface so that substantially all of the second part is illuminated; and at least some of the LEDs directing light at least to a third part of the desired surface so that substantially all of the third part is illuminated, the LEDs directing light at least to a third part not being associated with either the first set of lenses of or the second set of lenses.

6. The light array of claim 5 wherein at least some of the LEDs directing light to the third part of the surface also direct light to the first part of the surface.

7. The light array of claim 5 wherein at least some of the LEDs directing light to the third part of the surface also direct light to the second part of the surface.

8. The apparatus of claim 1 wherein said third LEDs also illuminate a portion of the middle area.

9. The apparatus of claim 1 wherein said third LEDs also illuminate a portion of the upper area.

10. The method of claim 4 wherein a first predetermined shape on said higher part of the surface overlaps an adjacent first predetermined shape on said higher part of the surface.

11. The method of claim 4 wherein a second predetermined shape on said central part of the surface overlaps an adjacent second predetermined shape on said central part of the surface.

12. The method of claim 4 wherein a first predetermined shape on said higher part of the surface overlaps an adjacent second predetermined shape on said central part of the surface.

13. The apparatus of claim 1 wherein the apparatus illuminates a billboard as the desired surface.

14. The light array of claim 5 wherein the light array illuminates a billboard as the desired surface.

15. The method of claim 4 wherein the light from each light source is oriented generally toward a billboard as the desired surface.

* * * * *